US007781652B2

(12) United States Patent
Clark et al.

(10) Patent No.: US 7,781,652 B2
(45) Date of Patent: Aug. 24, 2010

(54) UNIVERSAL GRAND PIANO PIANO ACTION WITH SIMULTANEOUS HALF STROKE KEYBOARD DESIGN CAPABILITY

(75) Inventors: Bruce E. Clark, Nottingham, NH (US); Kevin Burke, Haverhill, MA (US); Kirk Burgett, Sacramento, CA (US)

(73) Assignee: Wessell, Nickel & Gross, Sacramento, CA (US)

( * ) Notice: Subject to any disclaimer, the term of this patent is extended or adjusted under 35 U.S.C. 154(b) by 0 days.

(21) Appl. No.: 11/970,655

(22) Filed: Jan. 8, 2008

(65) Prior Publication Data

US 2008/0307943 A1 Dec. 18, 2008

Related U.S. Application Data

(63) Continuation-in-part of application No. 11/762,990, filed on Jun. 14, 2007, now Pat. No. 7,687,693.

(51) Int. Cl.
*G10C 3/18* (2006.01)

(52) U.S. Cl. ..... 84/239; 84/236

(58) Field of Classification Search ..... 84/239, 84/236
See application file for complete search history.

(56) References Cited

U.S. PATENT DOCUMENTS 7,129,403 B2 * 10/2006 Wroblewski ..... 84/239
7,141,728 B2 * 11/2006 Yoshisue et al. ..... 84/236

* cited by examiner

*Primary Examiner*—Jianchun Qin
(74) *Attorney, Agent, or Firm*—Craig A. Simmermon

(57) ABSTRACT

A universal grand piano piano action that has adjustable connections between the repetition base, heel, and rest cushion bracket of the piano action to provide a piano action that can be adjusted to fit any grand piano. Other components of the grand piano piano action, such as the jack and flanges, may require specific design and manufacture for each brand of grand piano. Universal grand piano piano action also allows true simultaneous half stroke keyboard design for both the white and sharp keys of a piano and includes the methods for installing simultaneous half stroke keyboard design into a grand piano.

5 Claims, 8 Drawing Sheets

UNIVERSAL GRAND PIANO PIANO ACTION WITH SIMULTANEOUS HALF STROKE KEYBOARD DESIGN CAPABILITY

CROSS-REFERENCE TO RELATED APPLICATIONS

The instant application is a continuation-in-part of U.S. application Ser. No. 11/762,990 entitled "Grand Piano Composite Piano Action" filed on Jun. 14, 2007 now U.S. Pat. No. 7,687,693, which is hereby incorporated by reference herein.

BACKGROUND OF INVENTION

A grand piano piano action comprises a repetition base, a balancier, a balancier regulating button, a jack, a jack regulating button, a heel, a rest cushion bracket, a rest cushion, a shank flange, a repetition flange, and a stop for jack regulating button. In order for an after-market grand piano piano action 10 to properly fit an existing grand piano configuration, the following must occur. 1) The repetition base 20 hole-to-hole distances must remain constant between the after-market and existing repetition bases. 2) The after-market action 10 must accommodate the existing capstan contact point 220 of the piano. 3) The shank flange and repetition flange 110 of the after-market action 10 must fit the existing rails on the piano. 4) The after-market jack 60 must have the appropriate shape to function properly with the two regulating buttons 80 and 90 of the action 10. 5) The rest cushion 40 and rest cushion bracket 30 must accommodate the existing hammer of the piano—noting that some grand piano designs require the rest cushions 40 to be attached to the repetition base 20 while others do not.

We have analyzed these requirements and created a universal piano action that can be installed into most grand pianos with very little inconvenience. Potential benefits include providing the capability for piano technicians and retail piano outlets to stock just one replacement action, namely the Universal Grand Piano Piano Action with Simultaneous Half Stroke Keyboard Design Capability, in order to reduce inventory while also having immediate stock on hand to repair or tune any grand piano at ready call. Benefits also include the ability to conveniently install proper simultaneous half stroke keyboard design for both the white and sharp keys into any grand piano.

OBJECT OF INVENTION

It is an object of this invention to produce a universal grand piano piano action that can be successfully installed in most grand pianos. This objective is met through a repetition base and a heel with an adjustable connection system between these members. The invention also includes members: rest cushion bracket, rest cushion, jack, jack regulating button, balancier, balancier regulating button, shank flange, and repetition flange. The novel design includes various modes of each component.

It is also an object of this invention to provide the capability to install simultaneous half stroke design for both the white and sharp keys into any grand piano. As noted in the parent application, half stroke design is useful because it is the optimum keyboard design that minimizes friction losses in the piano action and thereby results in a piano action with reduced touch weight, further resulting in a lighter, faster, and more responsive piano action.

DEFINITION LIST

Figure 1:
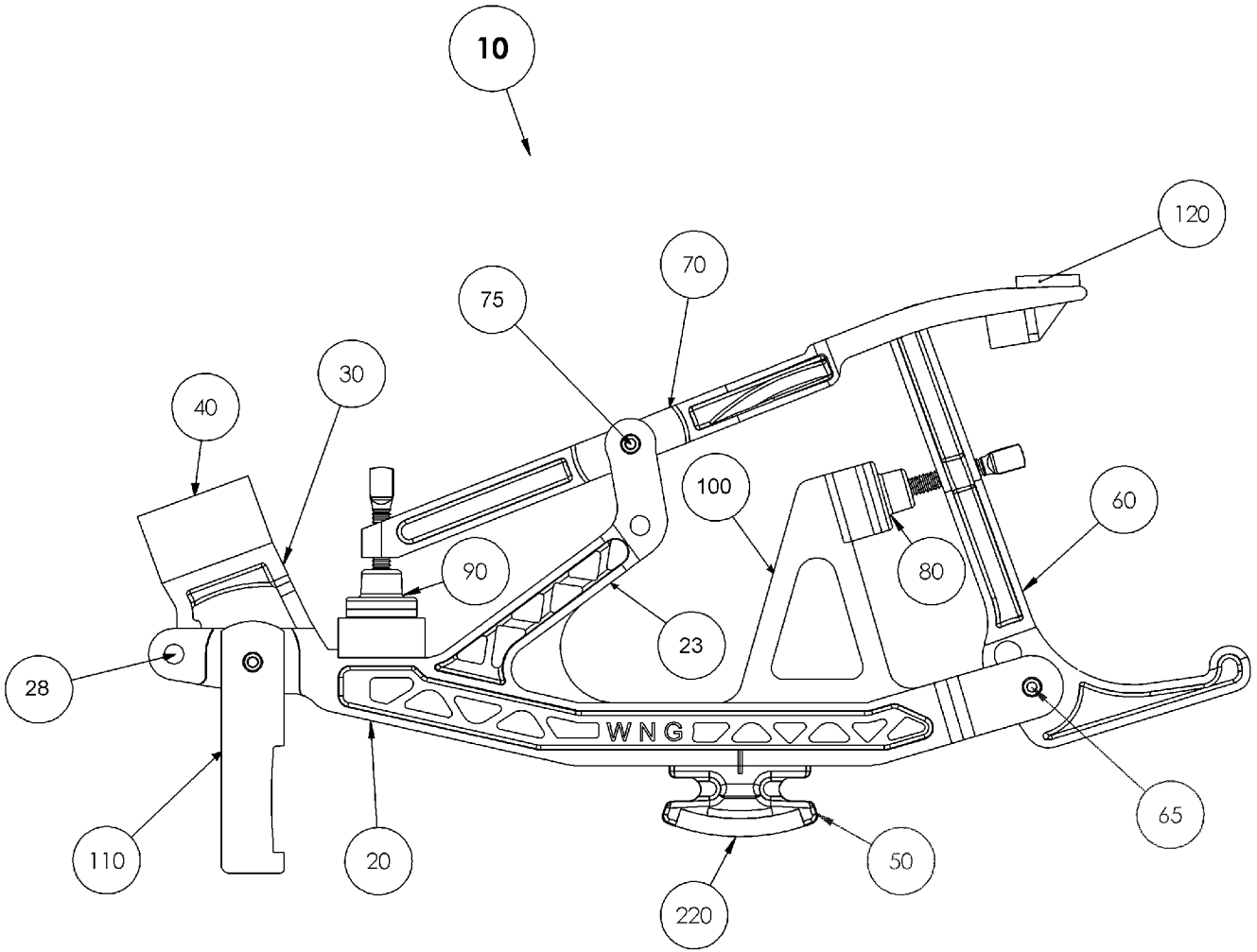
FIG. 1 is a front view of the best mode of a universal piano action.

| Term | Definition |
|---|---|
| 10 | Grand Piano Piano Action |
| 20 | Repetition Base |
| 23 | Balancier Support Beam |
| 25 | Main Beam |
| 28 | Repetition Base Center of Rotation |
| 30 | Rest Cushion Bracket |
| 40 | Rest Cushion |
| 50 | Heel |
| 60 | Jack |
| 65 | Jack Center of Rotation |
| 70 | Balancier |
| 75 | Balancier Center of Rotation |
| 80 | Jack Regulating Button |
| 90 | Balancier Regulating Button |
| 100 | Stop for Jack Regulating Button |
| 110 | Repetition Flange |
| 120 | Shank End of Balancier |
| 130 | Notches or Depressions |
| 140 | Ridges or Protrusions |
| 150 | Repetition Base Main Channel to Accept Heel Main Rib |
| 160 | Heel Main Rib |
| 170 | Heel Attachment Range |
| 180 | Repetition Location Notch |
| 190 | Heel Location Notch |
| 200 | Heel Orientation Notch |
| 210 | Jack Center Line |
| 220 | Capstan Contact Point |
| 225 | Heel Cushion |
| 230 | Nominal Heel Height |
| 240 | Rest Cushion Bracket Positioning Holes |
| 250 | Helper Spring Adjustment Hole on Repetition Base |
| 260 | Actual Heel Height |
| 270 | Rest Cushion Bracket Locating Pins |
| 280 | Helper Spring Adjustment Hole on Rest Cushion Bracket |
| 290 | Repetition Center Vertical Offset (VO) |
| 300 | Capstan Contact Horizontal Distance (HD) |
| 310 | Repetition Lower Lever Arm (RLLA) |

DETAILED DESCRIPTION OF EMBODIMENTS

A grand piano piano action 10 comprises: a repetition base 20, a balancier 70, a balancier regulating button 90, a jack 60, a jack regulating button 80, a heel 50, a rest cushion bracket 30, a rest cushion 40, a shank flange, a repetition flange 110, and a stop for jack regulating button 100. When a piano key is pressed, the repetition base 20 is pushed upwards pivotally about the repetition base center of rotation 28. Simultaneously, the jack 60 is moved generally upward together with the opposite end of the repetition base 20 causing the jack to push upward on the knuckle of the associated hammer assembly. Also simultaneously, the jack 60 lifts the balancier 70, which pivots about the balancier center of rotation 75. These two motions actuate a hammer assembly, causing the associated hammer to rotate and strike the associated set of piano strings or string. The depressed key thereby actuates the piano action 10 thereby generating piano tone. The piano action 10 also receives or catches the hammer after it strikes the strings and rebounds back against the action 10. When the pianist releases the depressed key, the action 10 returns to the initial rest position.

Figure 2:
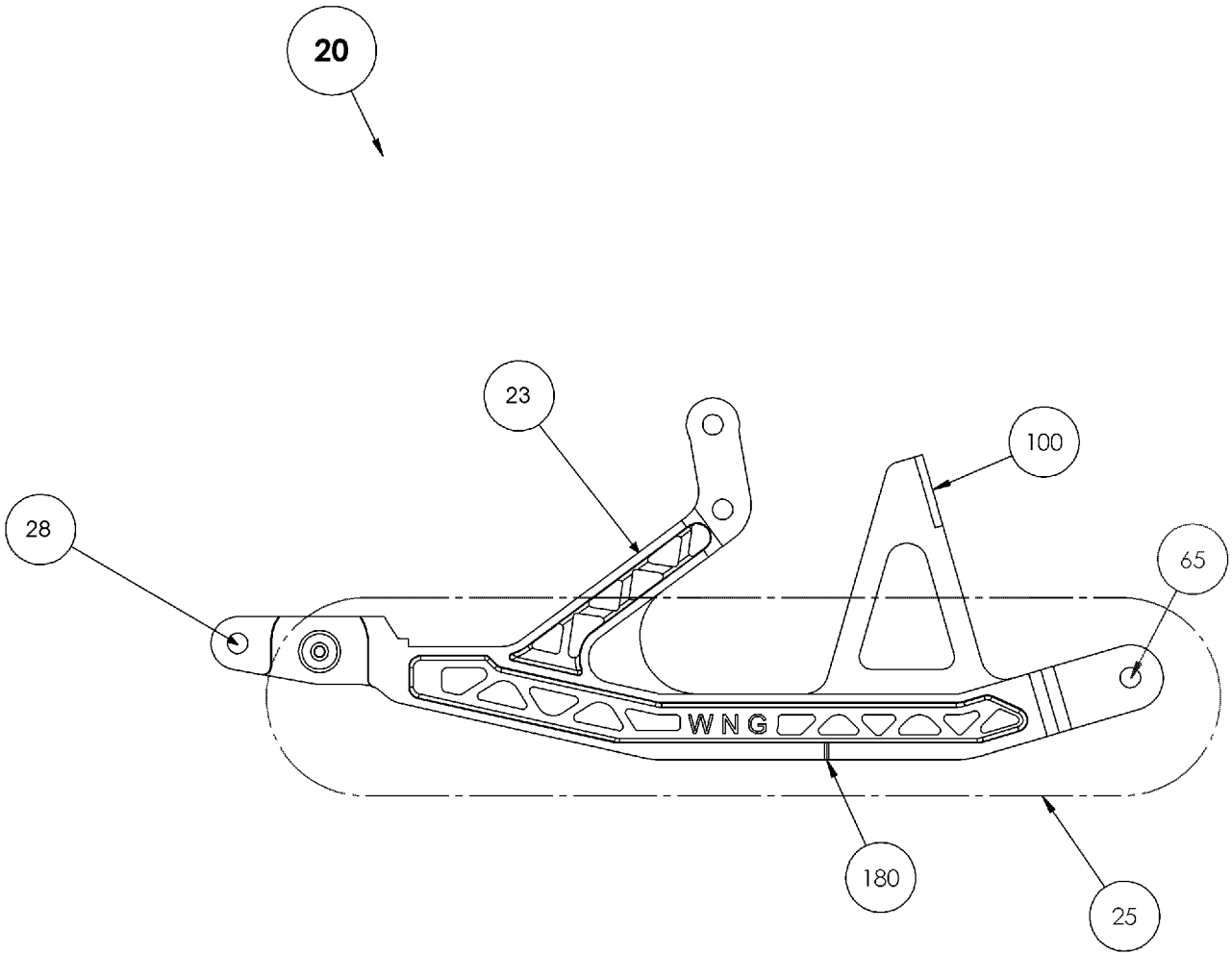
FIG. 2 is a front view of the best mode of a repetition base.
Figure 3:
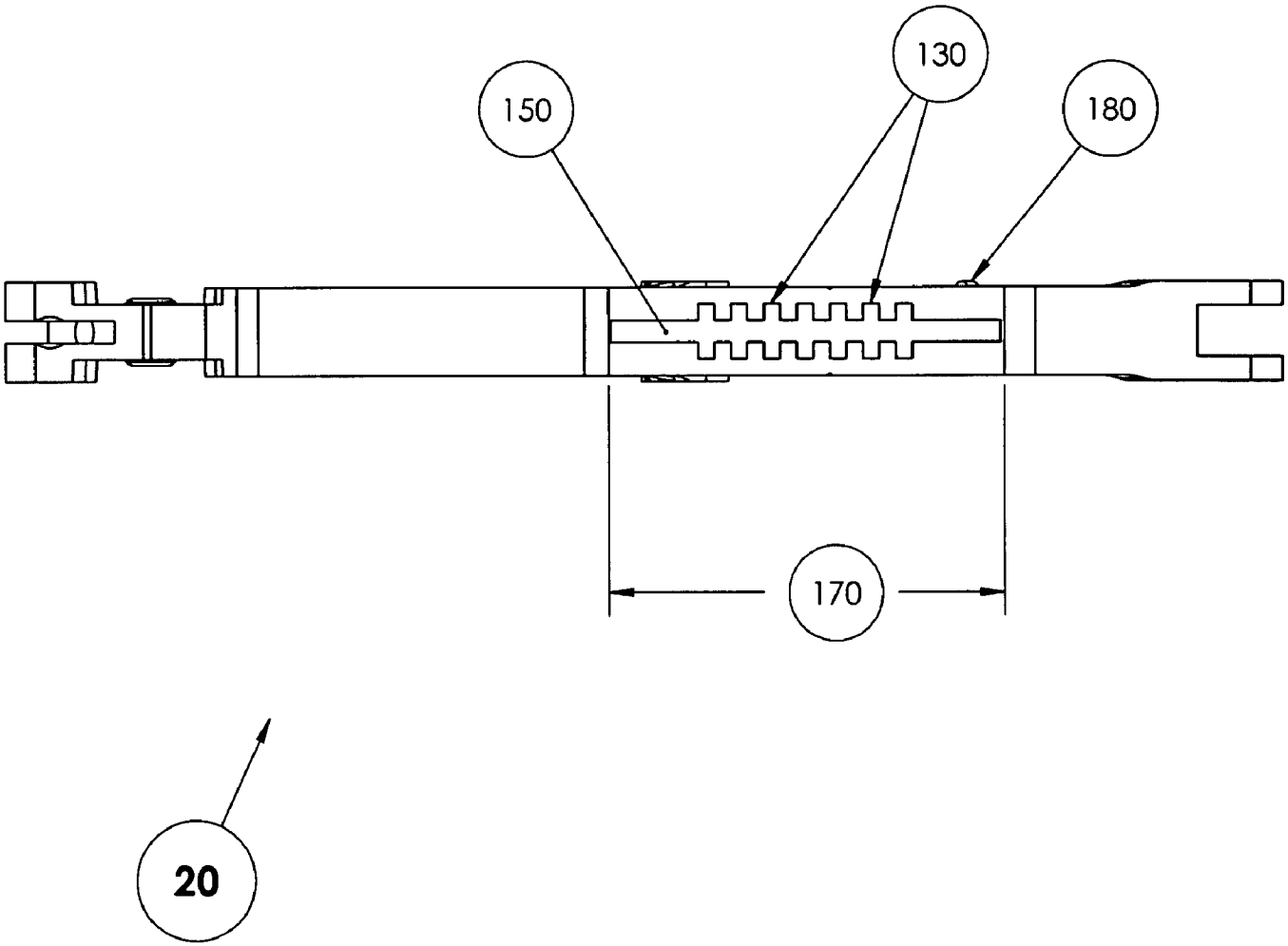
FIG. 3 is a bottom view of the best mode of a repetition base.
Figure 4:
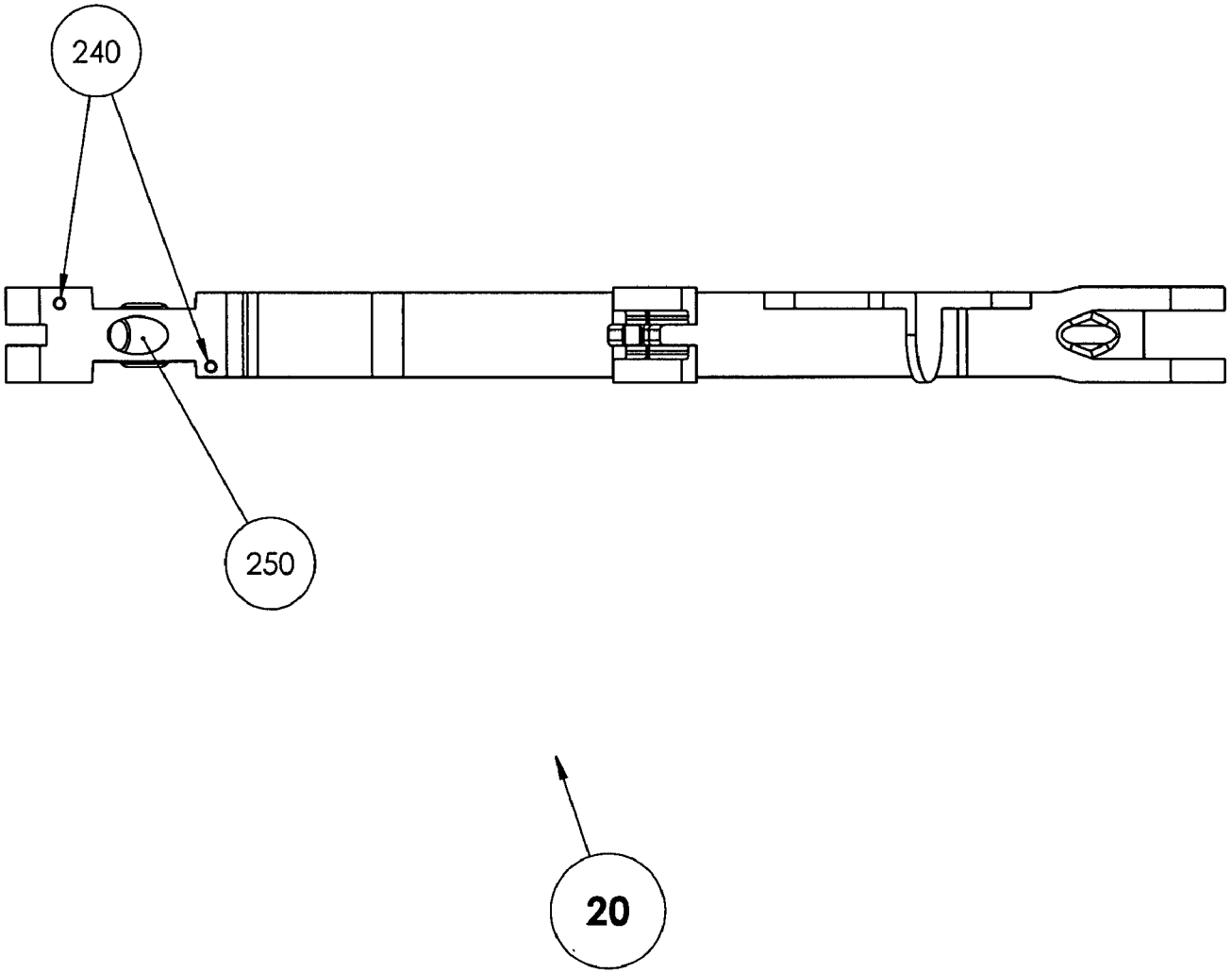
FIG. 4 is a top view of the best mode of a repetition base.

Repetition base for grand piano 20 is depicted in all of the figures. A repetition base 20 is also known as a wippen 20. Both prior art grand piano repetition bases and repetition bases of this invention comprise: a repetition main beam 25, a stop for jack regulating button 100, and a balancier support beam 23. See FIG. 2 for a depiction of these main elements of repetition base 20. The main beam 25 supports the balancier support beam 23 and the stop for jack regulating button 100 above main beam 25.

Figure 6:
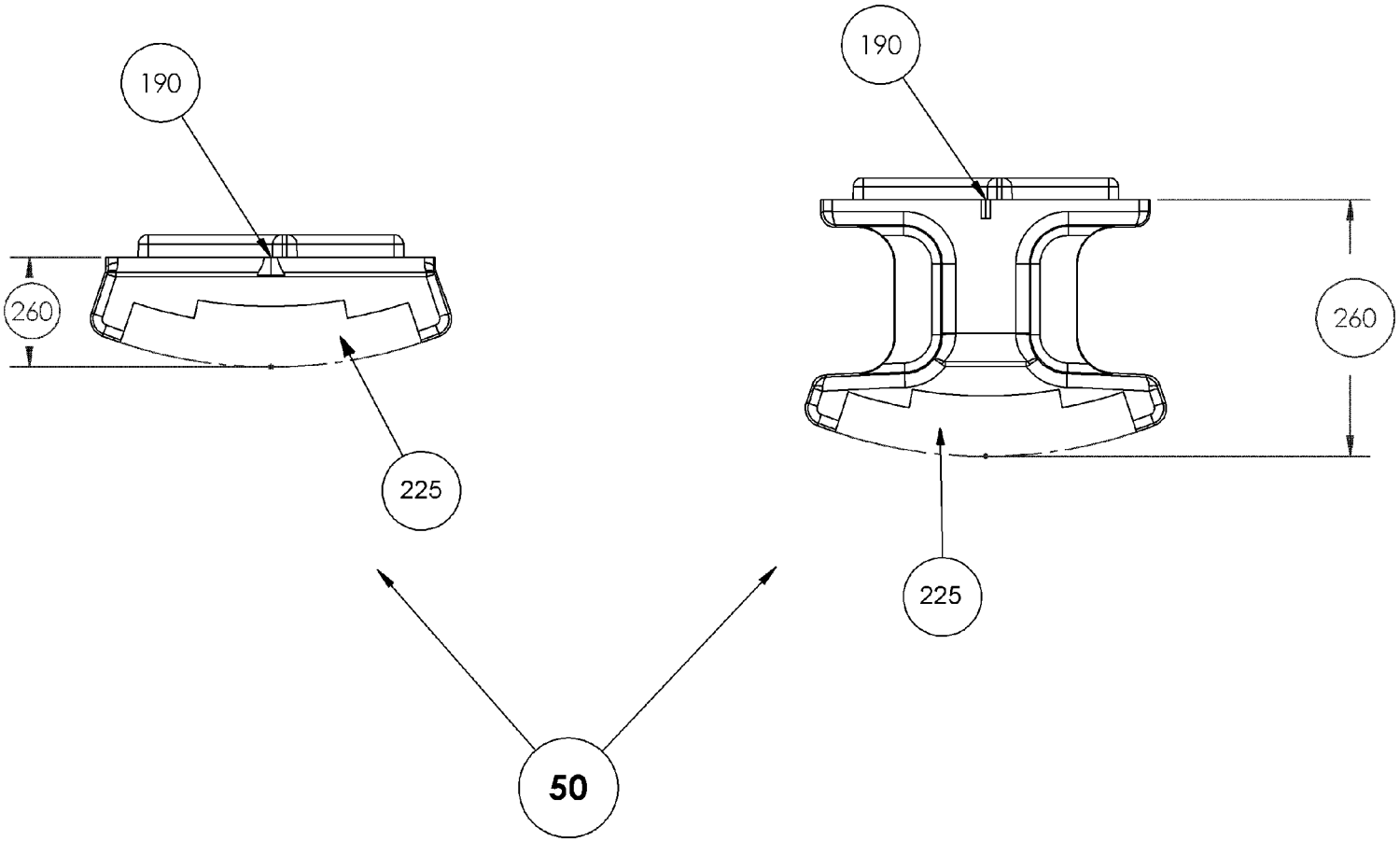
FIG. 6 is a side view of two heels with different heights.
Figure 7:
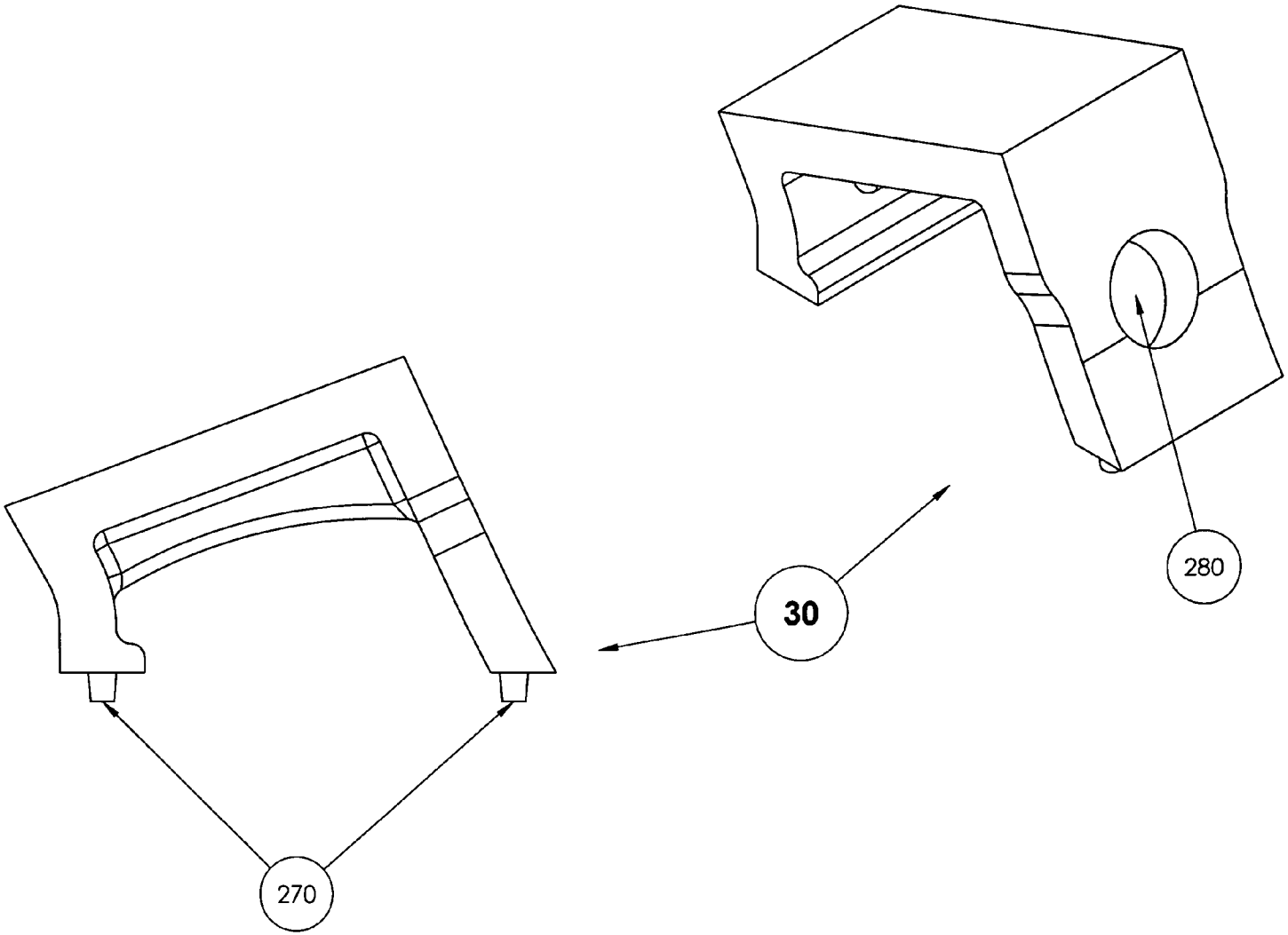
FIG. 7 is a side and perspective view of the best mode of a rest cushion bracket.

Grand piano piano action 10 includes a range of heels 50 with varying heights 260 that are capable of being installed into any manufacturer's grand piano. See FIG. 6. This is accomplished by allowing for the selection of heel 50 with proper height 260 for a specific brand of grand piano and further allowing the proper heel 50 to be attached to repetition base for grand piano 20 at various locations along the repetition main beam 25.

By varying the connection location between these two piano action components, the universal piano action 10 can conform to a specifically required distance between the existing repetition rail (located beneath repetition flange 110) and the existing row of capstan points 220 attached to the piano keys of the particular brand of grand piano.

Repetition base 20 may be connected to a rest cushion bracket 30 in order to fit those brands of grand piano that require an integral repetition base 20 with rest cushion 40, or the rest cushion bracket 30 may be left off to accommodate those brands that do not require such and integrated action member. If the rest cushion bracket 30 is not attached to the repetition base 20, the rest cushion bracket 30 is simply left in place on the existing piano and is not required for an action assembly 10 replacement. A specific rest cushion 40 is required for each brand of grand piano for which the after-market piano action 10 is to be installed.

Rest cushion bracket 30 supports the rest cushion 40 slightly above repetition base center of rotation 28 to allow clearance for the rotation of repetition base 20 during the cycling of piano action 10. Rest cushion 40 is made of soft padding material, typically felt. Rest cushion 40 supports a hammer shank (not depicted) of an associated hammer (not depicted) when the piano key is at rest or upon release of the hammer by the back check, which occurs when a depressed piano key is released. Rest cushion 40 must catch the hammer shank without causing the hammer to bounce back up from the rest cushion 40. Rest cushion 40 is connected to repetition base 20 by the rest cushion bracket 30. Any known means may be used to connect these three elements together. Typically, rest cushion 40 is glued to bracket 30 which is in turn glued to the repetition base 20. A mode of the repetition base 20 includes rest cushion bracket positioning holes 240. These holes act as universal positioning holes for whatever specific rest cushion bracket 30 may be required (if any) for a particular brand of grand piano. Pins 270 on the rest cushion bracket 30 mate with the rest cushion bracket positioning holes 240 on the repetition base 20 to provide for a convenient location and attachment means. Note that the pins could just have easily have been located on the repetition base and the holes located on the rest cushion bracket. This invention includes all connection systems to connect various versions of rest cushion brackets 30 to a repetition base 20 or rest cushion 40.

A specifically designed jack 60 may be required for each brand of grand piano for which the after-market piano action 10 is to be installed. This is because the length of jack 60 and tender of jack 60 must be held constant or exactly match that of prior art in order for the action 10 to function properly. This is required for proper dynamic interaction between the regulating buttons 80 and 90 of the action 10 and the hammer assemblies of the piano. A single mode of jack 60, however, may function properly in more than one brand of grand piano. For instance, the invention includes a single design of jack 70 that functions properly in all Steinway grand pianos as well as all Mason & Hamlin grand pianos.

A specific shank flange and repetition flange 110 must be designed for each brand of grand piano for which the after-market piano action 10 is to be installed.

A mode of the repetition base 20 is designed with notches 130 that are used to locate and accept ridges 140 on the heel 50. The repetition base 20 is also designed with a main channel 150 to locate and accept the heel main rib 160. One mode of the invention allows the heel 50 to be located and attached to the repetition base 20 along a 21 mm range at 170. This range is varied in other modes. After the proper position in the range has been determined, typically the heel 20 is permanently attached to the repetition base 20 with glue.

One mode of repetition base 20 has notches 130 separated by 3 mm center-to-center distances. A mode of heel 50 has ridges 140 offset from the center of the heel 50 by 1.5 mm. In this configuration, the heel 50 may be conveniently adjusted along the length of the repetition base 20 in 1.5 mm increments by rotating the heel 50 by 180° in relation to the repetition base 20 for each 1.5 mm increment. Alternately, the heel 50 could be moved by full 3 mm increments without such rotation of heel 50. This design allows for fast and precise location of the heel 50 onto the repetition base 20.

One mode of the repetition base 20 contains a location notch 180. Also, one mode of the heel 50 contains location notches 190, which are located at heel center. These notches provide an initial indication point or orientation point from which to start the location procedure between the two components. Some fine tuning procedures, such as proper simultaneous half stroke design, require exact positioning between the heel 50 and the repetition base 20. In addition, a mode of heel 50 includes an orientation notch 200. This notch is placed on one end only of heel 50 to provide additional orientation guidance regarding proper positioning of heel 50, noting that the orientation notch 200 may yield a 1.5 millimeter difference in location, depending on whether the notch 20 is on one side of the repetition base 20 or the other. These indicator points provide a convenient starting point from which to begin the precise location process in order to achieve certain desired keyboard conditions like true simultaneous half stroke keyboard design in a fast, convenient, and accurate way.

A calculation can be performed to yield instructions to create true simultaneous half stroke keyboard design for both the white and sharp keys of the piano. These instructions can be incorporated into a "half stroke design setup sheet" which can be used by a piano technician to install simultaneous half stroke keyboard design. The input data for such a calculation are the design criteria of the specific grand piano, called out below, and the design criteria of the universal piano action 10, also called out below. A half stroke design setup sheet comprises location instructions regarding the relative positioning of notches 180, 190, 200, as well as heel height 260.

Figure 5:
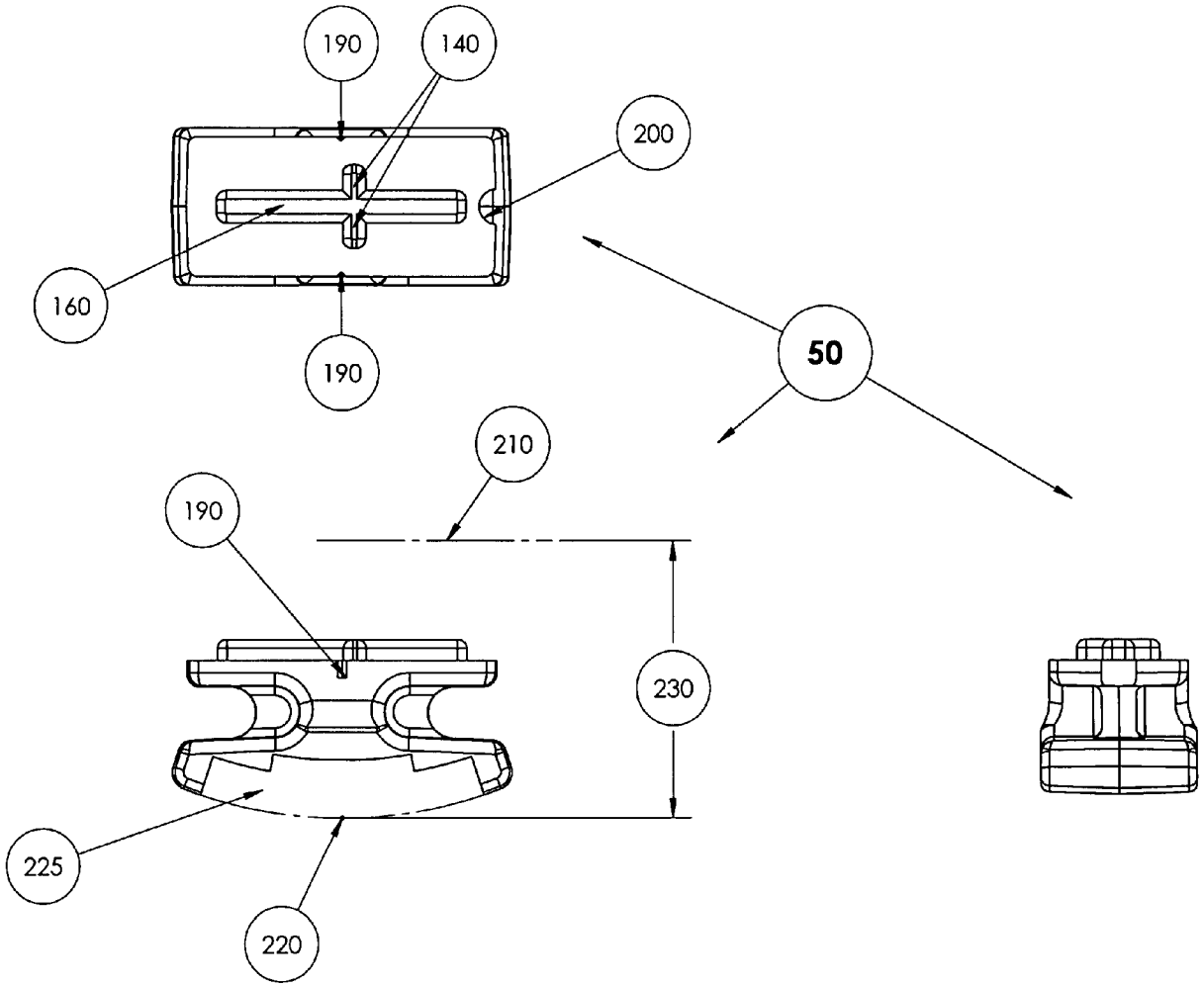
FIG. 5 is a side view, end view, and top view of a mode of a heel.
Figure 8:
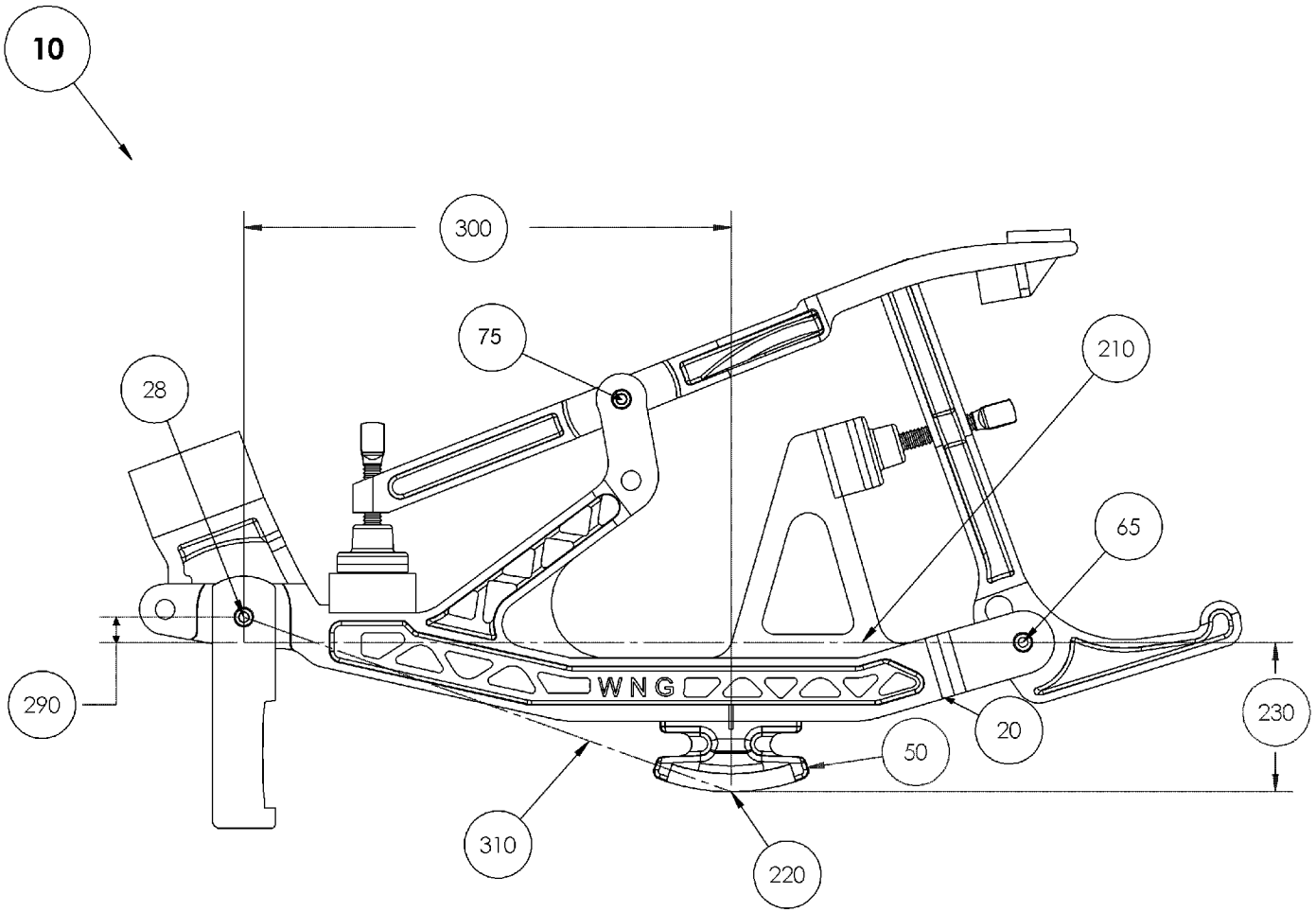
FIG. 8 is a graphic depiction of the best mode of a universal piano action, with attention drawn to half stroke design criteria.

The invention includes heels 50 with multiple heights in order to accommodate different piano designs and to allow for simultaneous half stroke design. In order to label heel height sizes with quantifications that are more conveniently feed into a half stroke design calculation, we have sized heels according to a nominal height 230. Nominal heel height 230 is defined as the perpendicular or vertical distance from the jack center line 210 to the capstan contact point 220 of a specific action corresponding to a particular brand of grand piano targeted for after-market replacement. See FIGS. 5 and 8 for a depiction of the nominal heel height 230. The jack center line 210 is defined as a hypothetical line stretching from the jack center of rotation 65 to a perpendicular intersect with the repetition flange 110. See FIG. 8 for a depiction of the jack center line 210. The capstan contact point 220 is the point at which the capstan of the piano key should contact the heel cushion 225. One mode of the invention includes 9 nominal heel height sizes, with a nominal heel height 230 ranging from 16-24 mm with 1 mm increments. The actual heel height 260 also may be referenced and is depicted on FIG. 6 for both a relatively short heel 50 and relatively tall heel 50.

In order to install the action components 10 disclosed in this application in a fashion that yields a proper simultaneous half stroke keyboard design, four critical dimensions of the piano action 10 must first be determined. These dimensions are: capstan contact horizontal distance 300 (HD), nominal heel height 230 (HH), repetition vertical offset 290 (VO), and repetition lower lever arm 310 (RLLA). See FIG. 8 for a depiction of these criteria. HD 300 is defined as the horizontal distance between the repetition base center of rotation 28 and capstan contact point 220. VO 290 is defined as the vertical distance between the repetition base center of rotation 28 and the jack center of rotation 65. RLLA 310 is defined as the diagonal distance between the repetition base center of rotation 28 and the capstan contact point 220. These criteria must first be determined in order to attain half stroke design because half stroke design calls for the exact placement of the capstan contact point 220 on the half stroke line. The half stroke line is defined as a theoretical line drawn from the repetition center of rotation 28 through the capstan contact point 220 and extending down to the corresponding key balance point, at a point in time when the repetition 20 is exactly half way through a key-strike cycle, where such cycle starts with the repetition at rest and ends with the striking of the corresponding piano string. The half stroke line is also defined in the parent application and is depicted in a figure in that application.

Note that RLLA 310 may still be adjusted to achieve half stroke design notwithstanding the fact that the capstan is necessarily fixed in location, as the capstan is preexisting, i.e. fixed in location on the preexisting grand piano. RLLA 310 can still be adjusted because the capstan contact point 220 may still be adjusted in location relative to the repetition base 20. The capstan contact point may be located at any point on the heel cushion 225. The heel cushion 225 is wide, relative to the capstan, and thus provides a range of location points on the heel cushion 225 relative for the capstan to support the piano action 10.

Any change in one of the criteria 300, 230, 290, or 310 necessarily changes the others, and therefore changes the capstan contact point 220 location. This is so because these distances make a right triangle with sides calculable by the Pythagorean Theorem. I.e., $RLLA^2=HD^2+(HH+VO)^2$; or, $\mathbf{310}^2=\mathbf{300}^2+(\mathbf{230}+\mathbf{290})^2$. Any change in one side of the right triangle necessarily changes the other sides of the right triangle. Also note that heels 50 of this invention are made according to a limited number of distinct heights 260; thus, criterion 230 is limited to a select number of distinct lengths as well. Also note that, with the best mode of this invention, heels 50 can only be attached to the repetition base 20 at certain distinct locations; thus, the capstan contact horizontal distance 300 is also limited to a certain number of distinct lengths. Hence, there is more than one variable in the geometry at hand, and two of the variables are limited, in the best mode, to certain distinct distances. To complicate matters even more, the Pythagorean Theorem is a non-linear equation. The net result is that half stroke criteria 300, 230, 290, or 310 cannot be calculated with simply one iteration of the calculation. Rather, we must undergo several iterations in order to determine the optimum capstan contact point 220 and its corresponding optimal criteria 300, 290, 230, and 310, in order to create a half stroke design setup sheet specifying the relative positioning of notches 180, 190, 200, as well as the optimal heel height 260 of the universal grand piano piano action 10.

To be optimal, i.e. yield half stroke design, the piano action 10 must yield a capstan contact point 20 location that is as close as possible to the half stroke line, within the limitations of the best mode which includes distinct limitations on distances 230 and 300. In other words, the half stroke design setup sheet should reference the location of point 220 that is as close as possible to the half stroke line using the best nominal heel height 230 and the best heel 50 repetition base 20 connection location.

The start of the calculation might first assume a certain nominal heel height 230, which is basically an initial guess of which heel height 260 will yield half stroke design. The first iteration would then yield a repetition lower lever arm 310 distance which then would be assessed to determine whether it yielded a capstan contact point 220 that lies on the half stroke line. If it doesn't, another heel height 260 is fed into another iteration of the calculation, yielding another repetition lower lever arm 310 distance and capstan contact point 220.

After each iteration described above, another group of iterations must be done to determine the optimum capstan contact horizontal distance 300. Thus, a certain heel location would feed into the calculation to yield a certain criteria 300 of the action 10, which then would be assessed against the previous determination of criteria 310 to determine whether both criteria yield half stroke design. The chances are that it will not, and thus more iterations would need to be conducted until optimal design criteria is determined. Since only one distance may be varied at a time in any one iteration of the calculation, very many iterations are required to hone in on the proper half stroke keyboard setup criteria.

This calculation lends itself to be conducted more efficiently by computer software. The applicants have devised such a computer program and will file for patent protection on this software.

Once the proper half stroke design setup sheet is determined, the piano technician can then assemble the heel 50 with optimal height 260 to the repetition base 20 at the optimal location, which results in a capstan contact point 220 that lies on the half stroke line. Proper simultaneous half stroke design for both the white and sharp keys requires this calculation to be done for each key of the piano. Note that, with the best mode, half stroke design can be succinctly and accurately communicated with simple instructions regarding the relative positioning of notches 180, 190, 200, as well as nominal heel height 230 for each key, both white and sharp, of a certain brand of grand piano. This application claims the method of installing into a grand piano proper simultaneous half stroke keyboard design.

What is claimed is:

1. A grand piano piano action comprising:

a repetition base with adjustable heel connection system, wherein said repetition base with adjustable heel connection system comprises:

at least two notches or depressions (130) on the lower surface of said repetition base with adjustable heel connection system, wherein said at least two notches or depressions is 0.2-15 mm in depth and is oblong-shaped with longitudinal axis essentially perpendicular to that of the lower surface of said repetition base with adjustable heel connection system, and a main channel (150) on the lower surface of said repetition base with adjustable heel connection system, wherein said main channel is 0.2-15 mm in depth and is oblong-shaped with longitudinal axis essentially parallel to that of the lower surface of said repetition base with adjustable heel connection system; and a heel with adjustable repetition base connection system, wherein said heel with adjustable repetition base connection system comprises:

at least one ridge or protrusion (140) on the upper surface of said heel with adjustable repetition base connection, wherein said at least one ridge or protrusion is 0.2-15 mm in height and is oblong-shaped with longitudinal axis essentially perpendicular to that of the upper surface of said heel with adjustable repetition base connection system, and a main rib (160) on the upper surface of said heel with adjustable repetition base connection, wherein said main rib is 0.2-15 mm in height and is oblong-shaped with longitudinal axis essentially parallel to that of the upper surface of said heel with adjustable repetition base connection system; wherein, said at least one ridge or protrusion is sized to snugly fit within any one of said at least two notches or depressions with proper clearance between the upper surfaces of said at least one ridge or protrusion and the lower surfaces of said at least two notches or depressions to allow for sturdy attachment of said heel with adjustable repetition base connection to said repetition base with adjustable heel connection system by gluing means, and said main rib is sized to snugly fit within said main channel with proper clearance between the upper surfaces of said main rib and the lower surfaces of said main channel to allow for sturdy attachment of said heel with adjustable repetition base connection to said repetition base with adjustable heel connection system by gluing means between said surfaces.

2. A grand piano piano action as recited in claim 1, wherein said repetition base with adjustable heel connection system further comprises a location notch or ridge (180), wherein said location notch or ridge is: a notch, depression, ridge, or protrusion on the front or rear surface of said repetition base with adjustable heel connection; contiguous with the lower edge of the front or rear surface; and is 0.2-15 mm in depth or height respectively.

3. A repetition base with adjustable heel connection system as recited in claim 1, wherein said repetition base with adjustable heel connection system further comprises a rest cushion bracket attached to one end, which is used to support a rest cushion which in turn supports the hammer when it is at rest.

4. A repetition base with adjustable heel connection system as recited in claim 3, wherein said repetition base with adjustable heel connection system further comprises a rest cushion bracket attached to one end, which is used to support a rest cushion which in turn supports the hammer when it is at rest.

5. A grand piano piano action as recited in claim 1, wherein said heel with adjustable repetition base connection system further comprises a location notch or ridge (190), wherein said location notch or ridge is: a notch, depression, ridge, or protrusion on the front or rear surface of said heel with adjustable repetition base connection; contiguous with the upper edge of the front or rear surface;

and is 0.2-15 mm in depth or height respectively.

* * * * *